US006829444B2

(12) United States Patent
Ashikawa

(10) Patent No.: US 6,829,444 B2
(45) Date of Patent: Dec. 7, 2004

(54) IMAGE FORMING APPARATUS, CHARGING UNIT, AND METHOD OF CONTROLLING OF VOLTAGE APPLIED TO CHARGING UNIT

(75) Inventor: Yoshihisa Ashikawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/610,562

(22) Filed: Jul. 2, 2003

(65) Prior Publication Data

US 2004/0037576 A1 Feb. 26, 2004

(30) Foreign Application Priority Data

Jul. 2, 2002 (JP) ..... 2002-193428
May 9, 2003 (JP) ..... 2003-132102

(51) Int. Cl.[7] ..... G03G 15/00; G03G 15/02
(52) U.S. Cl. ..... 399/44; 399/50
(58) Field of Search ..... 399/44, 46, 50, 399/97, 94, 174, 175, 176

(56) References Cited

U.S. PATENT DOCUMENTS 5,749,022 A * 5/1998 Kikui et al. ..... 399/50
5,805,954 A * 9/1998 Takahashi ..... 399/44
5,852,756 A * 12/1998 Teranishi et al. ..... 399/44

FOREIGN PATENT DOCUMENTS

JP 5-11571 1/1993

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes a photoconductive drum, a charging roller to charge the photoconductive drum, a thermistor to detect an ambient temperature of the photoconductive drum. A ROM stores impedance characteristics data that is obtained in advance by experiments and that represent a relationship between the ambient temperature of the photoconductive drum and an impedance between the charging roller and the photoconductive drum. Current ambient temperature of the photoconductive drum detected, current impedance between the charging roller and the photoconductive drum is calculated from the current ambient temperature of the photoconductive drum and the impedance characteristics data, and a voltage applied to the charging roller is adjusted based on the current impedance.

15 Claims, 7 Drawing Sheets

IMAGE FORMING APPARATUS, CHARGING UNIT, AND METHOD OF CONTROLLING OF VOLTAGE APPLIED TO CHARGING UNIT

BACKGROUND OF THE INVENTION

1) Field of the Invention

The present invention relates to charging a photoconductor drum, using a charger, with a voltage which is the sum of a direct current (DC) voltage and an alternating current (AC) voltage.

2) Description of the Related Art

Two types of charging, contact and non-contact charging, are used in conventional image forming apparatuses. In the contact charging, a charger is in contact with a surface of a body to-be-charged. The charger is charged with a desired electric potential and that electric potential is transferred (or to inject) to the body. On the other hand, in the non-contact charging, the charger does not contact the body. Corona discharging, which is used widely in charging units, is a typical example of the non-contact charging.

The contact charging has following advantages: 1) the charging can be performed with low voltage; 2) less ozone is generated during charging so that an ozone filter is not required; 3) since the ozone filter is not required, the exhaust system becomes simple; 4) the charging unit does not require any maintenance; and 5) the charging unit is simple.

In the contact charging, one approach is to apply an AC-DC composite voltage, which is an AC voltage superimposed on a DC voltage, to the photoconductive drum. If the photoconductive drum is charged with the AC-DC composite voltage, a uniform potential can be applied on the surface of the photoconductive drum. This is because, a surface potential of the photoconductive drum converges to the DC component corresponding to a dark area potential Vd of the photoconductive drum, by the AC component.

However, impedance between a charging roller and the photoconductive drum fluctuates depending on the environment conditions. In other words, if the environment conditions change, the AC component causes defective charging or charge leak. To cope with this problem, the impedance is monitored, and the AC component is varied according to the variation in the impedance. This will be called as constant current control.

However, the constant current control has a drawback that, when the charging roller passes over pinholes on the photoconductive drum, electrical noise is produced and/or the impedance changes sharply. The electrical noise or the change in the impedance affects the current to be controlled and even drop the applied voltage. This results into defective charging and bad image quality.

Japanese Patent Application Laid-Open No. 5-11571 discloses an image forming apparatus that solves the above-mentioned problem. Precisely, the image forming apparatus detects current of a charging AC component, for example, when the power is turned on. Then, an AC output voltage is varied till the current reaches to a target value, the value of the output voltage is stored in a memory under a control of a CPU, and the AC component is controlled based on this output voltage for a prescribed time.

However, the conventional image forming apparatuses disclosed in the above-mentioned publication requires an AC current detection circuit to be installed in a high voltage power supply. As a result, following problems arise:

1) Extra bit(s) is required to be added to a control signal for the high voltage power supply; and 2) configuration becomes complicated and costly.

Precisely, regarding the first problem, since the detected current (analogue value of voltage into which the current is converted) is transmitted to the CPU (which is provided outside of the high voltage power supply), it is necessary to add one bit for current feed back to the control signal. For example, an image forming apparatus for four colors requires further four bits for the control signal.

Regarding the second problem, for example, the CPU needs to prepare a routine which varies the duty factor of pulse width modulation (hereinafter, "PWM") signals to control the high voltage power supply such that an output current applied to the photoconductive drum indicates a desired value based on the AC current detected in a prescribed timing.

SUMMARY OF THE INVENTION

It is an object of the present invention to at least solve the problems in the conventional technology.

An image forming apparatus according to one aspect of the present invention includes a photoconductive drum to form a latent image; a charger that makes a contact with the photoconductive drum and charges the photoconductive drum; a developing unit that develops the latent image on the photoconductive drum; an environment information detection unit that detects current environment information about current environmental conditions around the photoconductive drum; a first memory unit that stores impedance characteristics data; and an impedance calculating unit that calculates an impedance between the charger and the photoconductive drum based on the present environment information and the impedance characteristics data.

A charging unit according to another aspect of the present invention includes an environment information detection unit that detects current environment information about current environmental conditions around a photoconductive drum forming a latent image; a first memory unit that stores impedance characteristics data; and an impedance calculating unit that calculates an impedance between the charger and the photoconductive drum based on the present environment information and the impedance characteristics data.

A method according to still another aspect of the present is of controlling a voltage applied to a charger making a contact with a photoconductive drum and charging the photoconductive drum. The method includes detecting current environment information about current environmental conditions around the photoconductive drum; calculating an impedance between the charger and the photoconductive drum based on the present environment information and impedance characteristics data; and generating the voltage which is an alternating current voltage superimposed on a direct current voltage, based on the impedance calculated.

The impedance characteristics data is obtained in advance by experiments and represents a relationship between environment information about environmental conditions around the photoconductive drum and impedance between the charger and the photoconductive drum.

The other objects, features and advantages of the present invention are specifically set forth in or will become apparent from the following detailed descriptions of the invention when read in conjunction with the accompanying drawings.

DETAILED DESCRIPTION

Figure 1:
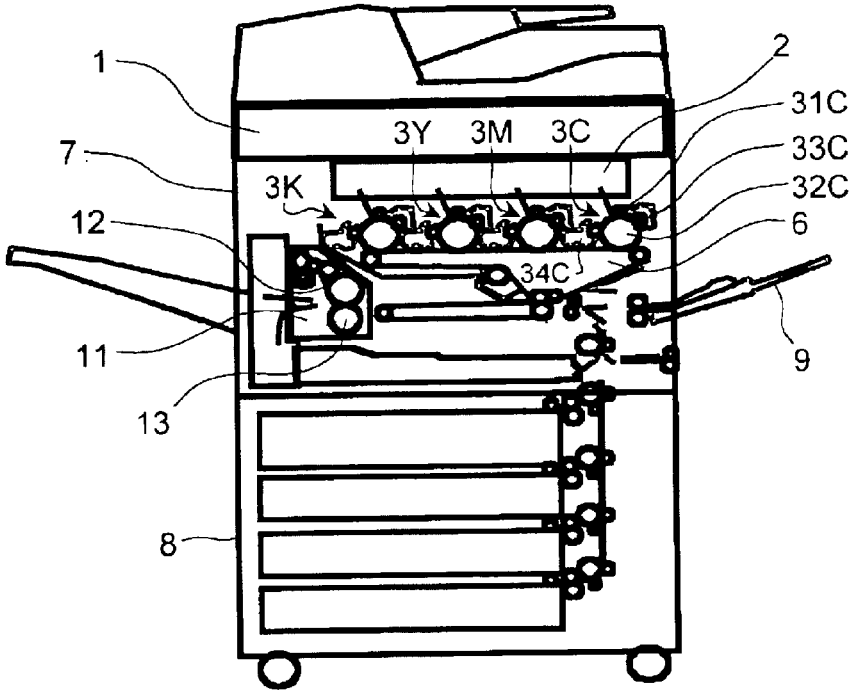
FIG. 1 is a cross sectional view of an image forming apparatus according to a first embodiment.

Exemplary embodiments of the image forming apparatus, the charging unit, and the method of controlling a voltage applied to the charging unit relating to the present invention will be explained in detail below with reference to the accompanying drawings. Like reference characters designate corresponding parts in the several views. In the explanation, it is assumed that the image forming apparatus according to the present invention is a color tandem copy machine.

FIG. 1 is a cross sectional view of an image forming apparatus according to a first embodiment. The image forming apparatus includes a scanning section 1, a writing section 2, and image forming units 3C, 3M, 3Y, and 3K. The scanning section 1 irradiates a paper document, and then converts light reflected from the paper document into electric signals. The electric signals is processed as image information in the scanning section 1.

The writing unit 2 irradiates laser beam that is modulated by the PWM signals based on the image information, on respective photoconductive drums of the image forming units 3C, 3M, 3Y, and 3K. The image forming units 3C, 3M, 3Y, and 3K form toner images based on the laser beam irradiated from the writing section 2, where C, M, Y, and K represent cyan, magenta, yellow, and black respectively.

The image forming unit 3C includes a photoconductive drum 32C, a developing unit 33C, and a drum cleaner 34C. The photoconductive drum 32C, after its surface is charged uniformly by a charging roller 31C, forms a latent image based on the laser light irradiated from the writing section 2. The developing unit 33C deposits toner on the latent image formed on the photoconductive drum 32C. In other words, the developing unit 33C forms a toner image. The drum cleaner 34C cleans residual toner on the photoconductive drum 32C. The other image forming units 3M, 3Y, and 3K have identical structures to the image forming unit 3C.

Moreover, the image forming apparatus includes an intermediate transfer belt 6 that transfers the respective toner images which are deposited on the photoconductive drums 32C, 32M, 32Y, and 32K to a paper. Furthermore, the image forming apparatus includes a main body 7 (copying machine for single-sided copying), and a paper feeding bank 8 that possesses a plurality of paper feeding trays. The main body 7 possesses at least one paper feeding tray, a manual feed tray 9, and a fixing unit 11 that fixes the toner image on the paper, which is carried by a carrying section, by heating and applying pressure. The fixing unit 11 includes a fixing roller 12 that heats the paper and a pressure roller 13 that applies pressure on the paper.

Figure 2:
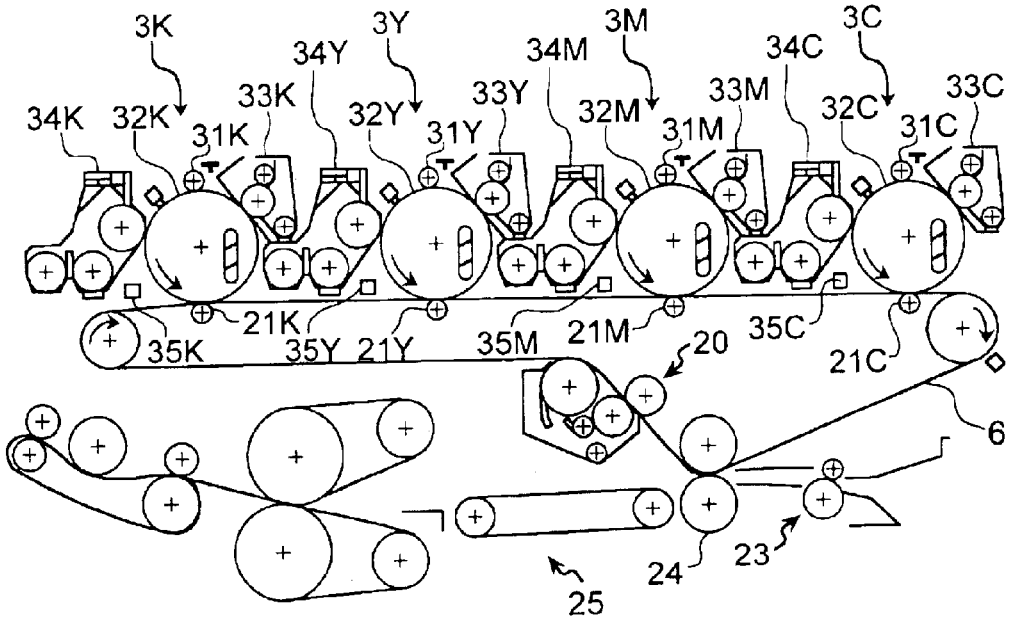
FIG. 2 illustrates a detailed mechanism of image forming units and around an intermediate transfer belt shown in FIG. 1.

FIG. 2 illustrates a detailed mechanism of the image forming units 3C, 3M, 3Y, and 3K and around the intermediate transfer belt 6 shown in FIG. 1. In the image forming units 3C, 3M, 3Y, and 3K, latent images of four colors are formed on the photoconductive drums 32C, 32M, 32Y, 32K respectively. The toner images are developed on the latent images formed on the photoconductive drums 32C, 32M, 32Y, and 32K, by the developing units 33C, 33M, 33Y, and 33K. The toner images formed on the photoconductive drums 32C, 32M, 32Y, and 32K are transferred to the intermediate transfer belt 6 through primary transfer rollers 21C, 21M, 21Y, and 21K to form color images. The toner images transferred to the intermediate transfer belt 6 are transferred to a paper that is fed by a paper separating mechanism 23, through a secondary transfer roller 24. The paper is then carried to a paper carrier mechanism 25. Residual toner on the photoconductive drums 32C, 32M, 32Y, and 32K is cleaned by the drum cleaner 34C, 34M, 34Y, and 34K respectively and residual toner on the intermediate transfer belt 6 is cleaned by a belt cleaner 20.

In the structure of the image forming apparatus, thermistors 35C, 35M, 35Y, and 35K are provided in the vicinity of the photoconductive drums 32C, 32M, 32Y, and 32K to detect ambient temperatures of the photoconductive drums 32C, 32M, 32Y, and 32K.

Figure 3:
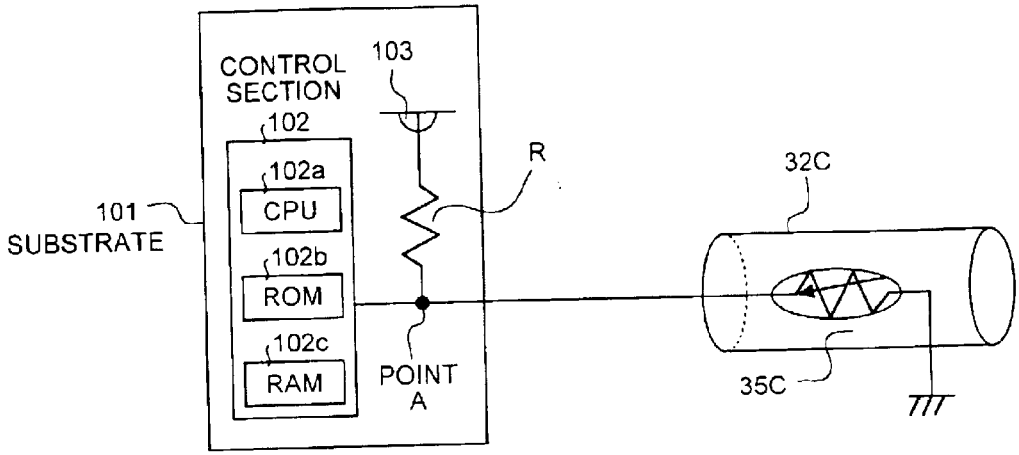
FIG. 3 illustrates a mechanism that detects impedance between a charging roller and a photoconductive drum.

FIG. 3 illustrates a mechanism that detects impedance between the charging roller and the photoconductive drum. The mechanism is identical among structures for C, M, Y, and K, and therefore the mechanism for C is explained below as a representative of other colors.

Voltage is applied on the thermistor 35C from a power supply 103 through a resistor R. Analogue voltage divided at a point A between the resistance R and the thermistor 35C is input to a control section 102 mounted on a substrate 101. Since the resistance of the thermistor 35C varies depending on the temperature, the analogue voltage at point A also varies depending on the temperature.

The control section 102 includes a CPU 102*a*, a ROM 102*b*, a RAM 102*c*. The ROM 102*b* stores data and programs to be executed by the CPU 102*a*. The CPU 102*a* calculates impedance between the charging roller 31C and the photoconductive drum 32C according to a program and data that are stored in the ROM 102*b*. The RAM 102*c* is used as a work area of the CPU 102*a*.

Figure 4:
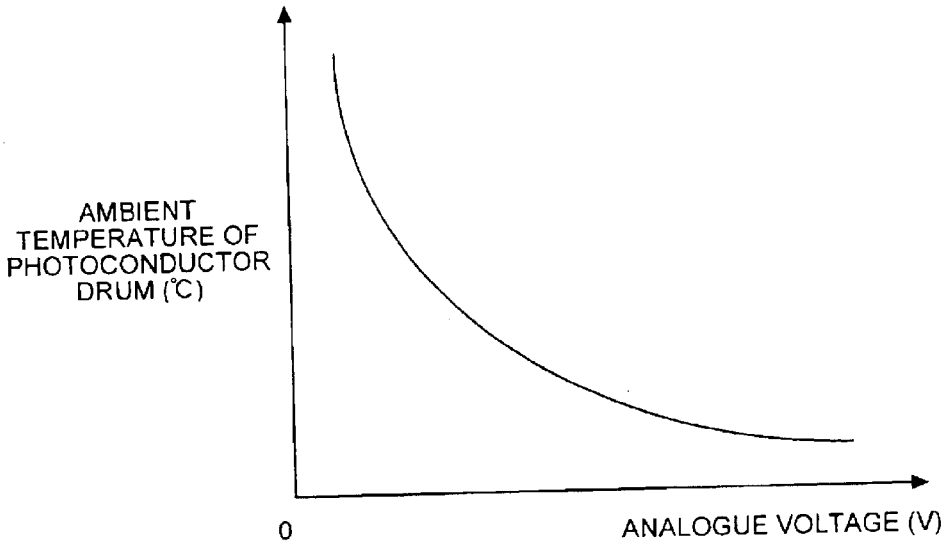
FIG. 4 is a graph of ambient temperature of the photoconductive drum and analogue voltage at point A in FIG. 3.

The ROM 102*b* stores voltage—temperature conversion data in either of tabular form and arithmetic expression. The voltage—temperature conversion data indicate relationship between the analogue voltage at the point A shown in FIG. 3 and the ambient temperature of the photoconductive drum 32C. FIG. 4 is a voltage—temperature graph corresponding to the voltage—temperature conversion data. The horizontal axis of the graph indicates analogue voltage (volt) at the point A and the vertical axis indicates ambient temperature (degree Celsius) of the photoconductive drum 32C.

Figure 5:
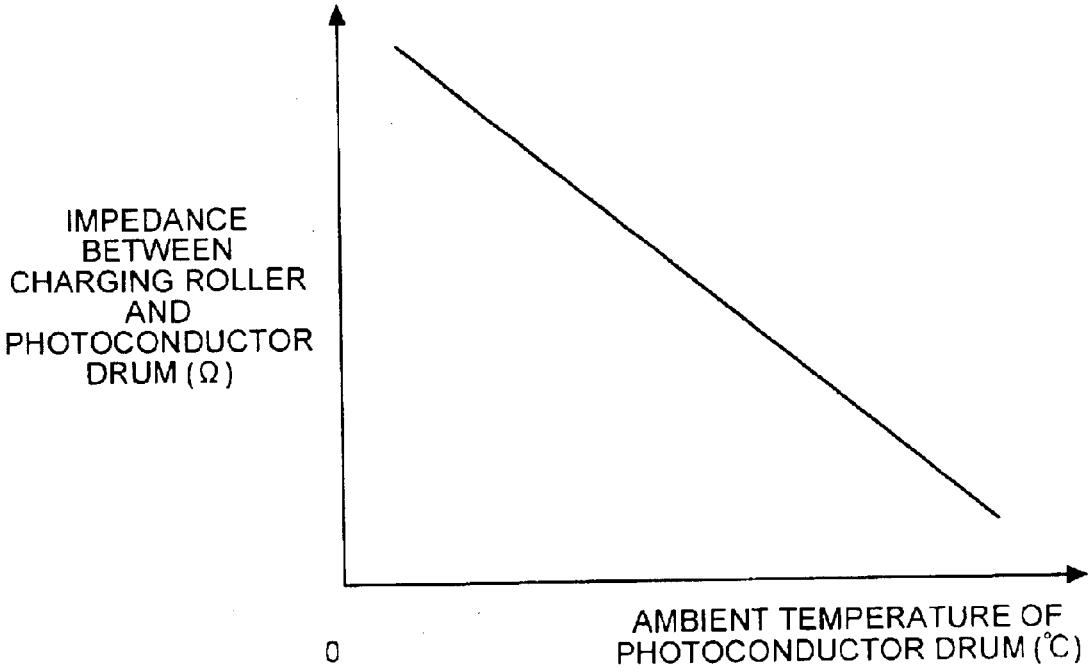
FIG. 5 is graph of the ambient temperature of the photoconductive drum and the impedance between the charging roller and the photoconductive drum.

Moreover, the ROM 102*b* also stores impedance characteristics data in either of tabular form and arithmetic expression. The impedance characteristics data indicate relationship between the ambient temperature of the photoconductive drum 32C and the impedance between the charging roller 31C and the photoconductive drum 32C. FIG. 5 is a temperature—impedance graph corresponding to the impedance characteristics data. The horizontal axis of the graph indicates ambient temperature (degree Celsius) of the photoconductive drum 32C and the vertical axis indicates the impedance (ohm) between the charging roller 31C and the photoconductive drum 32C.

The CPU 102*a* calculates the ambient temperature of the photoconductive drum 32C from the analogue voltage at the point A, by referring to the voltage—temperature conversion data (see FIG. 4) stored in the ROM 102*b*. Then, the CPU 102*a* calculates the impedance between the charging roller 31C and the photoconductive drum 32C from the calculated ambient temperature of the photoconductive drum 32C, by referring to the data of impedance characteristics (see FIG. 5) stored in the ROM 102*b*.

As a result, according to the first embodiment, a structure, which consists of the control section 102, resistors R, and the thermistors 35C, 35M, 35Y, and 35K, to accurately detect each impedance between the charging rollers 31C, 31M, 31Y, and 31K and the photoconductive drums 32C, 32M, 32Y, and 32K, becomes simple and low cost.

Figure 6:
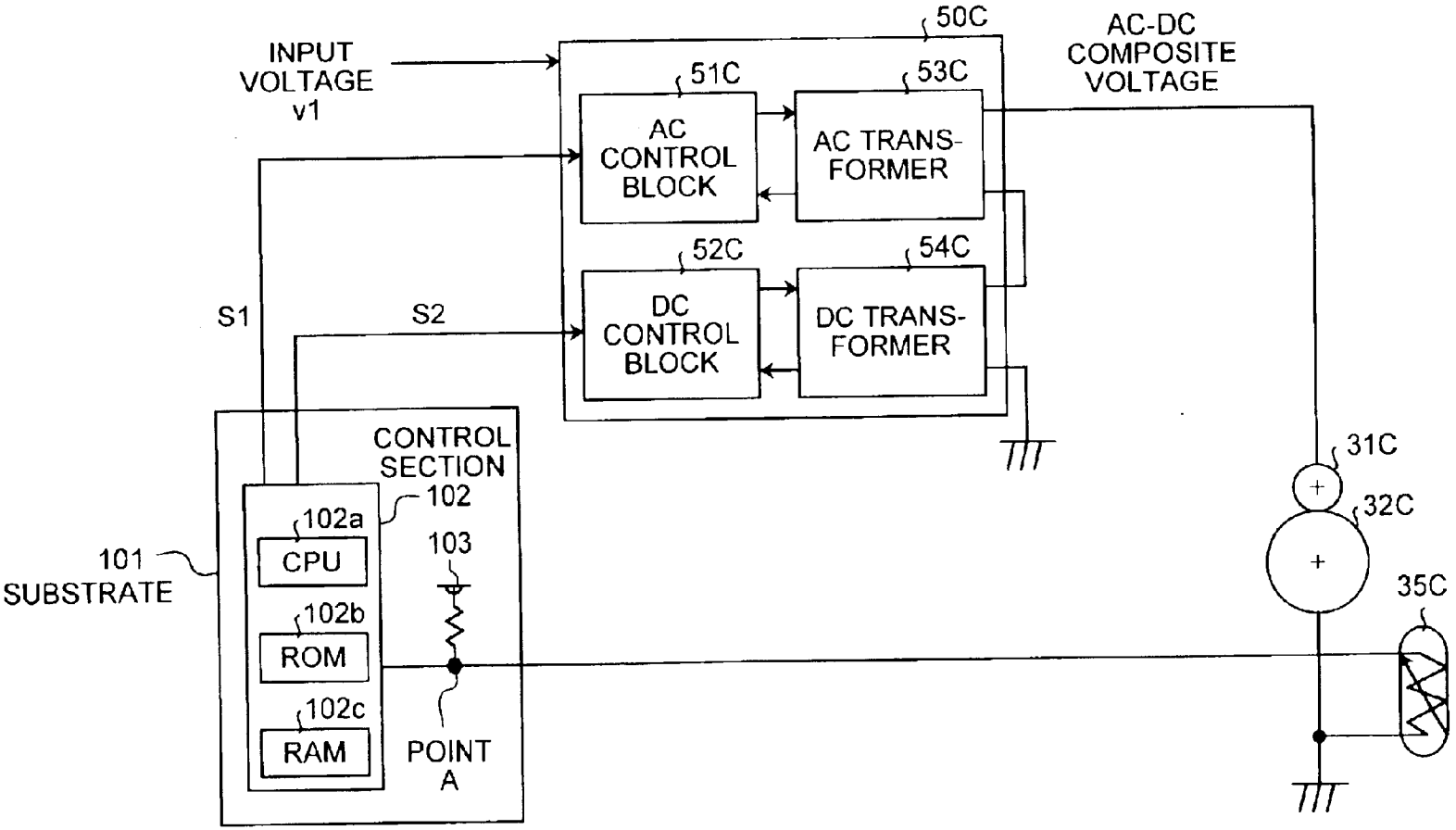
FIG. 6 is a schematic of a part of an image forming apparatus according to a second embodiment.

FIG. 6 illustrates a schematic structure of a part of an image forming apparatus according to a second embodiment, and the part corresponds to the structure shown in FIG. 3. The image forming apparatus detects the impedance between the charging roller and the photoconductive drum in the same manner as that in the first embodiment, and controls a high voltage supply for charging, based on the detected impedance.

The high voltage power supply 50C for charging applies an AC-DC composite voltage, which is an AC voltage superimposed on a DC voltage, to the charging roller 31C.

Figure 7:
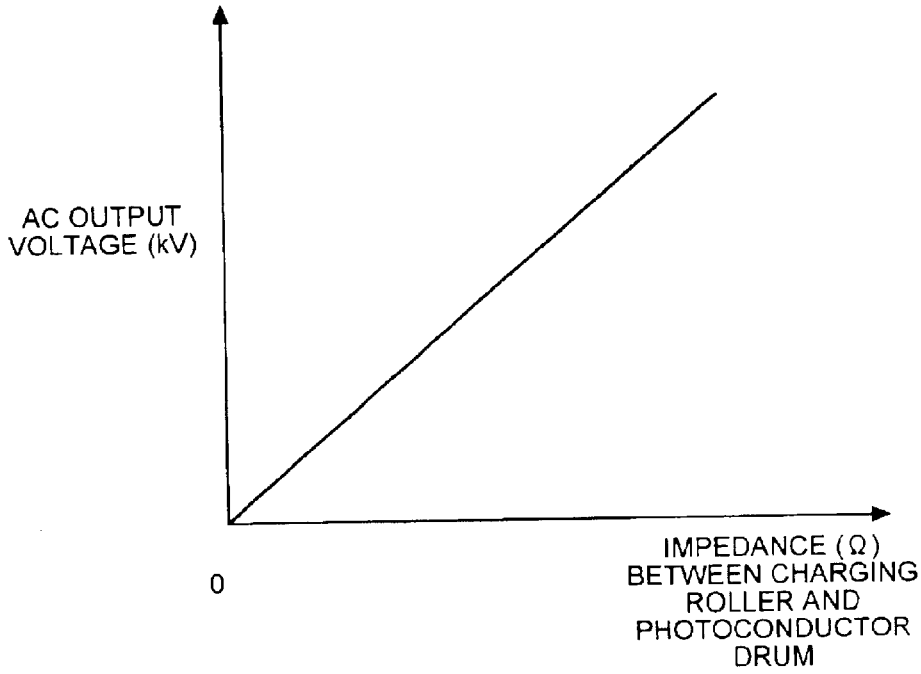
FIG. 7 is a graph of an AC output voltage applied to the charging roller and the impedance between the charging roller and the photoconductive drum.

The control unit 102 detects the impedance between the charging roller 31C and the photoconductive drum 32C and controls the high voltage power supply 50C. The ROM 102*b* stores impedance—AC output voltage conversion data in either of tabular form and arithmetic expression. The impedance—AC output voltage conversion data indicate relationship between the impedance between the charging roller 31C and the photoconductive drum 32C and the AC output voltage (kilovolt). The AC output voltage is an AC component of the AC-DC composite voltage, and is controlled feedback by the high voltage power supply 50C. FIG. 7 is an impedance—AC output voltage graph corresponding to the impedance—AC output voltage conversion data. The horizontal axis of the graph indicates impedance (ohm) between the charging roller 31C and the photoconductive drum 32. The vertical axis indicates AC output voltage (kilovolt) that is applied by the high voltage power supply 50C on the charging roller 31C, with respect to each impedance value between the charging roller 31C and the photoconductive drum 32C.

Figure 8:
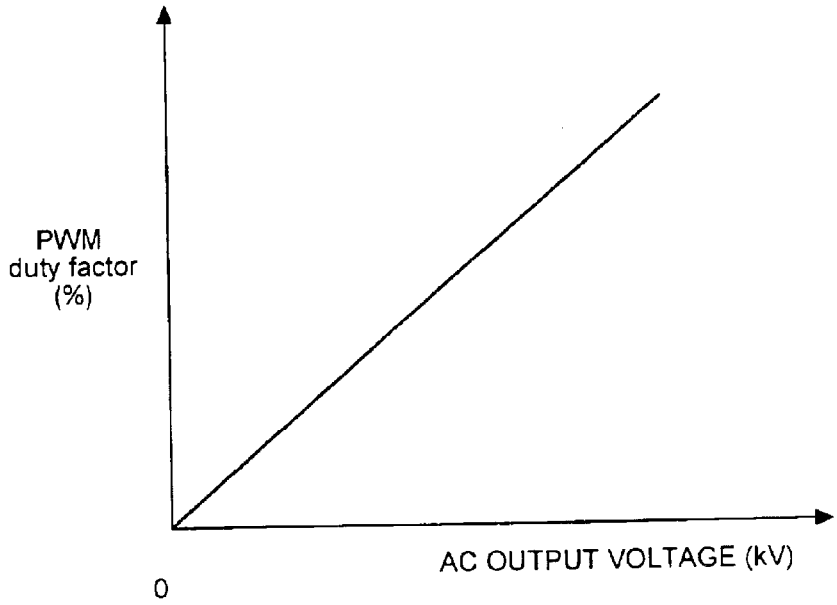
FIG. 8 is a graph of the AC output voltage and the duty factor of PWM signal transmitted to a high power supply unit.

Moreover, the ROM 102*b* stores AC output voltage—PWM_DUTY conversion data. The AC output voltage—PWM_DUTY conversion data indicate relationship between the AC output voltage and the duty factor of PWM signal to generate the AC output voltage. FIG. 8 is an AC output voltage—PWM_DUTY graph corresponding to the AC output voltage—PWM_DUTY conversion data. The horizontal axis of the graph indicates AC output voltage level (kilovolt) that is applied on the charging roller 31C by the high voltage power supply 50C and the vertical axis indicates the duty factor (percentage) of the PWM signal to set the AC output voltage.

The CPU 102*a* calculates impedance between the charging roller 31C and the photoconductive drum 32C in the same manner as that in the first embodiment. Next, the CPU 102*a* calculates the value of AC output voltage to be output from the high voltage power supply 50C from the calculated impedance, by referring to the impedance—AC output voltage conversion data (see FIG. 7) stored in the ROM 102*b*. Then, the CPU 102*a* calculates duty factor of the PWM signal corresponding to the calculated value of AC output voltage, by referring to the PWM_DUTY conversion data (see FIG. 8), and outputs a PWM signal S1 of the calculated duty factor to the high voltage power supply 50C. Moreover, the CPU 102*a* outputs a PWM signal S2 of a duty factor corresponding to DC component (volt) of the AC-DC composite voltage to the high voltage power supply 50C.

The high voltage power supply 50C generates an AC output voltage and a determined DC output voltage, based on the PWM signals S1 and S2 and outputs the AC-DC composite voltage which is the AC output voltage superimposed on the DC output voltage. The AC-DC composite voltage is applied to the charging roller 31C.

The high voltage power supply 50C includes an AC control block 51C, a DC control block, an AC transformer 53C, and a DC transformer 54C. The AC transformer 53C generates an AC voltage for charging by boosting an input voltage v1 (volt). The AC control block 51C works such that the AC transformer 53C outputs the AC output voltage indicated by the PWM signal S1. Specifically, the AC control block 51C detects an AC output voltage that is fed back from the AC transformer 53C, and controls the AC transformer 53C so that the AC output voltage indicates a value of the voltage indicated by the PWM signal S1.

The DC transformer 54C generates a DC voltage for charging by boosting the input voltage v1. The DC control block 52C works such that the DC transformer 54C outputs the DC output voltage indicated by the PWM signal S2. Specifically, the DC control block 52C detects a DC output voltage that is fed back from the DC transformer 54C, and controls the DC transformer 54C so that the DC output voltage indicates a value of the voltage indicated by the PWM signal S2.

In other words, the AC control block 51C controls the AC transformer 53C so that an AC voltage having a constant amplitude is output and the DC control block 52C controls the DC transformer 54C so that a constant DC voltage is output. As a result, the charging roller 31C applied with the AC-DC composite serves as a charger, and charges the photoconductive drum 32C.

According to the second embodiment, the charging roller 31C is applied with an appropriate voltage depending on impedance between the charging roller 31C and the photoconductive drum 32C, by a simple and low cost structure, which consists of the control section 102, the AC control block 51C, the DC control block 52C, the AC transformer 53C, and the DC transformer 54C. In other words, it is possible to prevent leak, defective charging etc of the charging roller 31C even by using a simple and low cost structure.

The conventional image forming apparatus need a structure for detecting the charging AC output current. On the contrary, the image forming apparatus according to the second embodiment does not require not only the current detecting mechanism but also an interface with the CPU 102*a* and a mechanism for feeding the value of the detected AC voltage current back to the CPU 102*a*. Moreover, since the high voltage power supply 50C is controlled according to the PWM signals to apply a constant voltage to the charging roller 31C, the image forming apparatus does not require a mechanism for constant current control of the AC voltage for the charging roller 31C, and thereby it is possible to reduce the cost of the high voltage power supply 50C.

Figure 9:
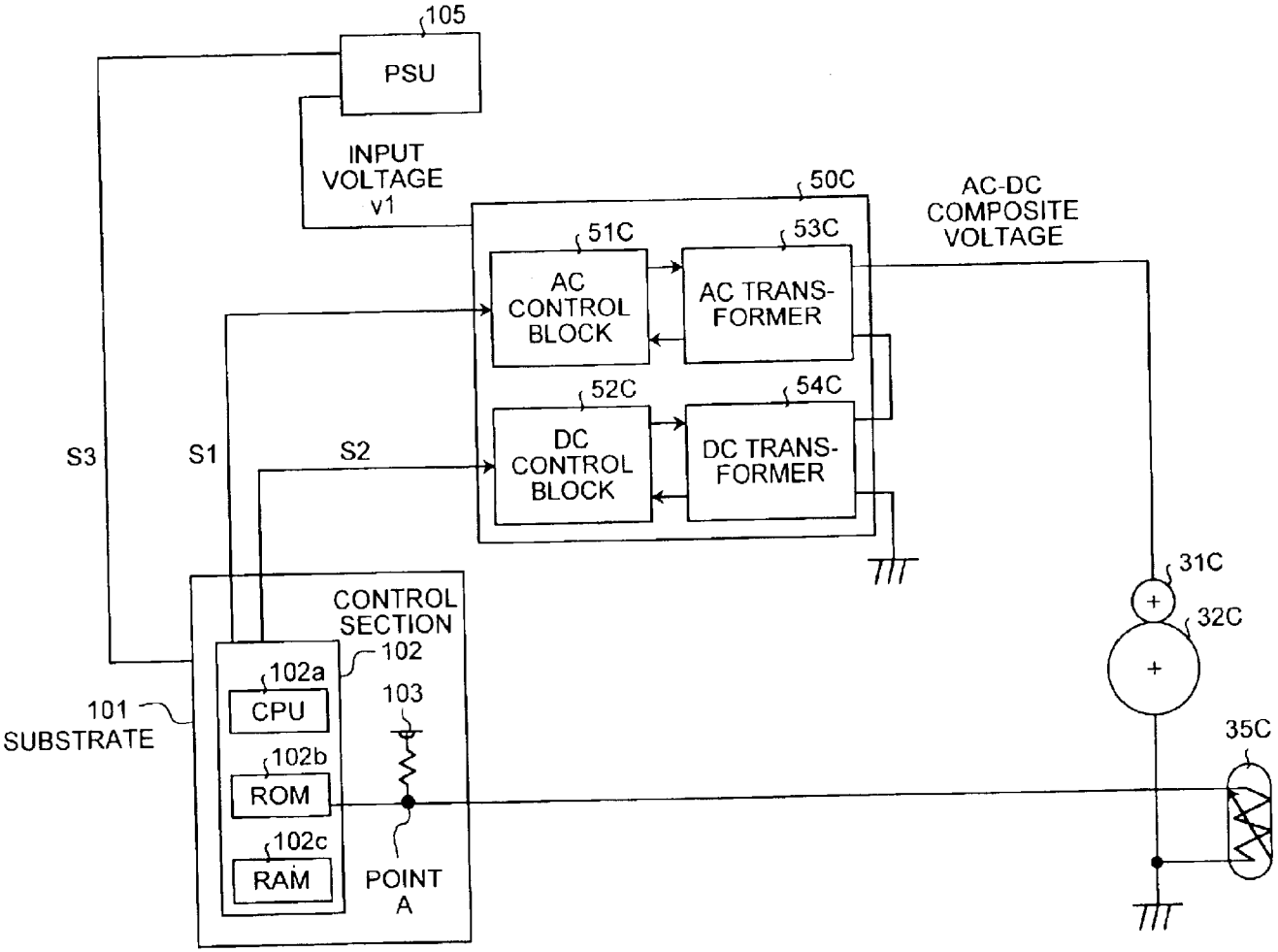
FIG. 9 is a schematic of a part of an image forming apparatus according to a third embodiment.

FIG. 9 illustrates a schematic structure of a part of an image forming apparatus according to a third embodiment, the part corresponds to the structure shown in FIG. 6. The image forming apparatus according to the third embodiment includes an operation unit 104 and a power supply unit (hereinafter, "PSU") 105 in addition to the structure shown in FIG. 6, to stop the copying process in case of an abnormal voltage at the point A detected through at least one of the thermistors 35C, 35M, 35Y, and 35K.

The operation unit 104 is for providing operation instructions to the control section 102 and for displaying various information. The PSU 105 supplies an input voltage v1 to the high voltage power supply 50C.

Figure 10:
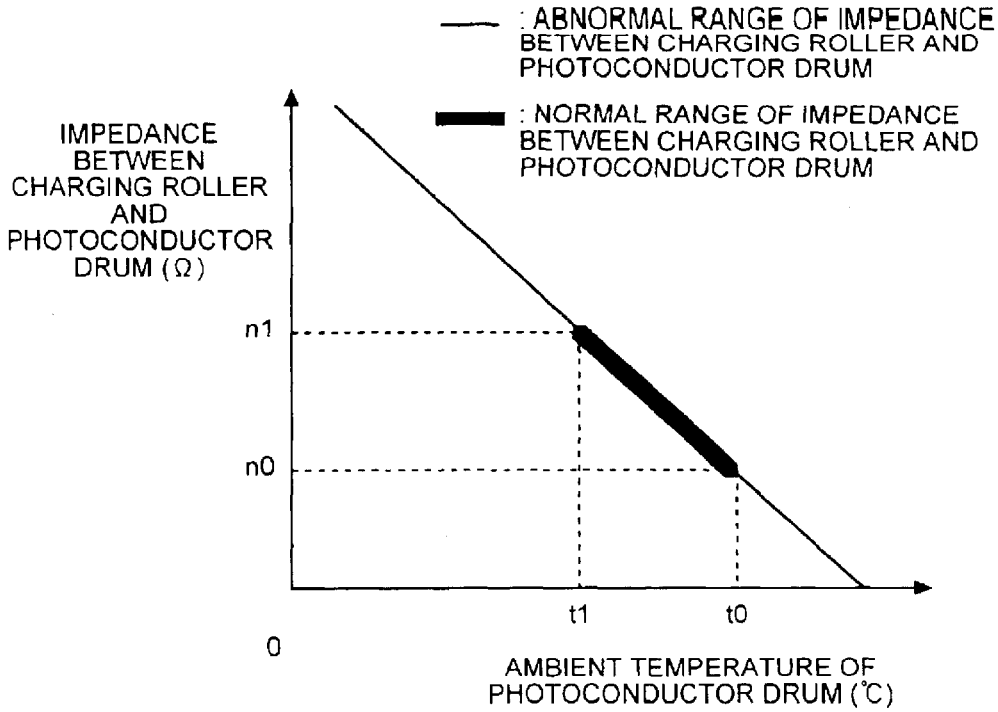
FIG. 10 illustrates a normal range of the impedance and an abnormal range of the impedance on the graph shown in FIG. 5.

FIG. 10 illustrates a normal range of the impedance and an abnormal range of the impedance on the graph shown in FIG. 5. The normal range is represented by a thick bold line and the abnormal range by thin solid lines. From FIG. 10, it is shown that a range of the ambient temperature of the photoconductive drum 32C corresponding to the normal range from n0 to n1 is from t1 to t0.

Figure 11:
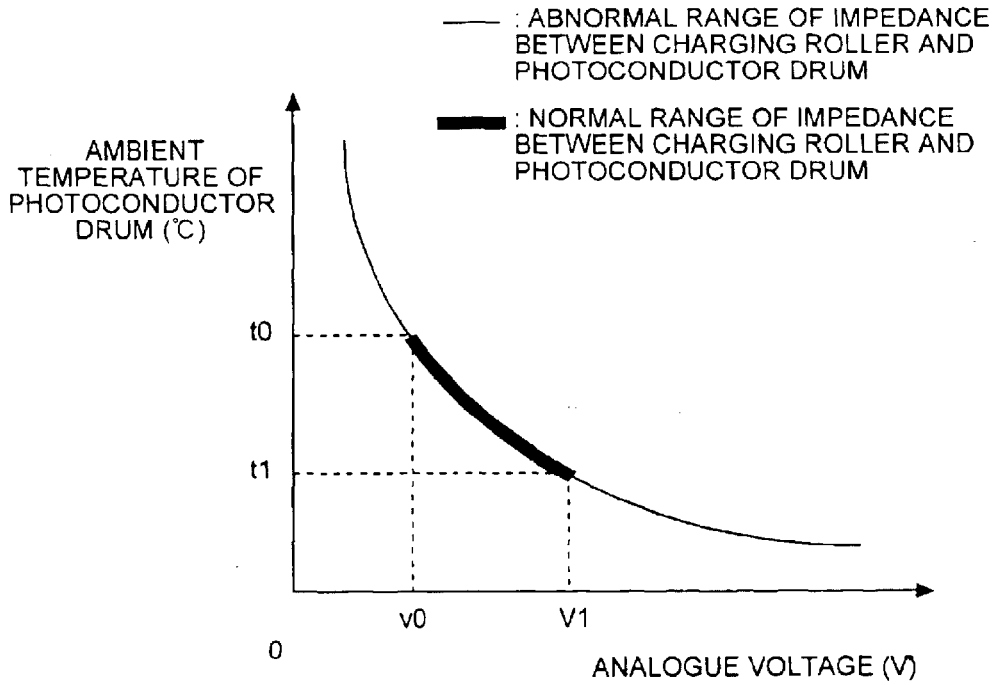
FIG. 11 illustrates a normal range of the impedance and an abnormal region of impedance on the graph shown in FIG. 4.

FIG. 11 illustrates a normal range of the impedance and an abnormal region of impedance on the graph shown in FIG. 4. The normal range is represented by a thick bold line and the abnormal range by thin solid lines. From FIG. 11, it is shown that a range of analogue voltage (hereinafter, "normal voltage range") corresponding to the range of the ambient temperature of the photoconductive drum 32C from t1 to t0 is from v0 to v1 (volt). That is, the normal voltage range corresponds to the normal range of the impedance. Therefore, detection of the analogue voltage enables the control section 102 to judge whether the impedance between the charging roller 31C and the photoconductor drum 32C is within the normal or the abnormal range. The normal voltage range from v0 to v1 is stored in the ROM 102*b*.

The CPU 102*a* monitors whether or not the analogue voltage at the point A shown in FIG. 3 is within the normal voltage range. When the analogue voltage is out of the normal voltage range, the CPU 102*a* stops the copying process, sets the duty factors of the PWM signals S1 and S2 to 0%, and stops the voltage supply from the high voltage power supply 50C to the charging roller 31C. The CPU 102*a* then transmits an OFF signal S3 to the PSU 105, to stop the supply of the input voltage v1 to the high voltage power supply 50C. After that, the CPU 102*a* causes the operation unit 104 to display information in which the impedance between the charging roller 31C and the photoconductor drum 32C is abnormal, such as a serviceman call message.

In a normal operation, there is hardly any possibility of detection of abnormal temperature. However, when a connector of the thermistor 35C comes off for example, the CPU 102*a* recognizes that the impedance is maximum and thus transmits the PWM signal S1 with 100% duty factor corresponding to the maximum AC output voltage (see FIG. 7), to the high voltage power supply 50C. When the thermistor blows for another example, the CPU 102*a* recognizes that the impedance is minimum and thus transmits the PWM signal S1 with 0% duty factor corresponding to the minimum AC output voltage (see FIG. 7), to the high voltage power supply 50C. The PWM signal S1 with 100% duty factor during a period causes the charging roller 31C to be applied with a high AC voltage continuously. This continuous high AC voltage on the charging roller 31C is hazardous from safety point of view. To prevent this, when the analogue voltage detected at the point A is out of the normal voltage range, the CPU 102*a* stops the copying process, the voltage supply from the high voltage power supply 50C to the charging roller 31C, and the supply of input voltage v1 from the PSU 105 to the high voltage power supply 50C.

In the first, second, and third embodiments, although the thermistors are provided for respective four colors, the control of charging rollers 31C, 31M, 31Y, and 32K for respective four colors can be carried out based on the detection output from one thermistor. The frequency of the AC output voltage instead of the level of the AC output voltage may be controlled based on the impedance between the charging roller and the photoconductive drum. Furthermore, in these embodiments, although the ambient temperature of the photoconductive drum is used as environment information of the photoconductive drum, the ambient humidity instead of the ambient temperature, or both the ambient temperature and temperature can also be used as environment information of the photoconductive drum.

The present document incorporates by reference the entire contents of Japanese priority documents, 2002-193428 filed in Japan on Jul. 2, 2002 and 2003-132102 filed in Japan on May 9, 2003.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising:

a photoconductive drum to form a latent image;

a charger that makes a contact with the photoconductive drum and charges the photoconductive drum;

a developing unit that develops the latent image on the photoconductive drum;

an environment information detection unit that detects current environment information about current environmental conditions around the photoconductive drum;

a first memory unit that stores impedance characteristics data, wherein the impedance characteristics data is obtained in advance by experiments and represents a relationship between environment information about environmental conditions around the photoconductive drum and impedance between the charger and the photoconductive drum; and an impedance calculating unit that calculates an impedance between the charger and the photoconductive drum based on the present environment information and the impedance characteristics data.

2. The image forming apparatus according to claim 1, wherein the environment information includes an ambient temperature of the photoconductive drum.

3. The image forming apparatus according to claim 1, further comprising:

a high voltage supply unit that applies to the charger an AC-DC composite voltage, wherein the AC-DC composite voltage is an alternating current voltage superimposed on a direct current voltage; and a voltage control unit that controls the high voltage supply unit based on the impedance calculated so that the AC-DC composite voltage is constant.

4. The image forming apparatus according to claim 3, further comprising:

a second memory unit that stores impedance—output voltage conversion data, wherein the impedance—output voltage conversion data is obtained in advance by experiments and represents a relationship between an impedance between the charger and the photoconductive drum and output voltage applied to the charger, wherein the voltage control unit calculates an output voltage to be applied to the charger from the impedance calculated by the impedance calculating unit, by referring to the impedance—output voltage conversion data, and controls the high voltage supply unit so that the high voltage supply unit outputs the output voltage calculated as the AC-DC composite voltage.

5. The image forming apparatus according to claim 3, wherein the voltage control unit transmits a pulse width modulation signal to the high voltage supply unit, and the high voltage supply unit generates an output voltage from the pulse width modulation signal, and applies the output voltage generated to the charger.

6. The image forming apparatus according to claim 1, further comprising:

a protection unit that judges whether the environment information is out of a predetermined range, based on impedance between the charger and the photoconductive drum.

7. The image forming apparatus according to claim 6, wherein the protection unit causes the high voltage supply unit to stop applying the output voltage to the charger upon a judgment by the protection unit that the environment information is out of the range.

8. The image forming apparatus according to claim 6, wherein the protection unit outputs a signal indicating abnormality upon a judgment by the protection unit that the environment information is out of the range.

9. The image forming apparatus according to claim 1, being a color tandem machine that forms color images.

10. A charging unit, comprising:

an environment information detection unit that detects current environment information about current environmental conditions around a photoconductive drum forming a latent image;

a first memory unit that stores impedance characteristics data, wherein the impedance characteristics data is obtained in advance by experiments and represents a relationship between environment information about environmental conditions around the photoconductive drum and impedance between the photoconductive drum and a charger making a contact with the photoconductive drum and charging the photoconductive drum; and an impedance calculating unit that calculates an impedance between the charger and the photoconductive drum based on the present environment information and the impedance characteristics data.

11. The charging unit according to claim 10, wherein the environment information includes an ambient temperature of the photoconductive drum.

12. The charging unit according to claim 10, further comprising:

a high voltage supply unit that applies to the charger an AC-DC composite voltage, wherein the AC-DC composite voltage is an alternating current voltage superimposed on a direct current voltage; and a voltage control unit that controls the high voltage supply unit based on the impedance calculated so that the AC-DC composite voltage is constant.

13. A method of controlling a voltage applied to a charger making a contact with a photoconductive drum and charging the photoconductive drum, comprising:

detecting current environment information about current environmental conditions around the photoconductive drum;

calculating an impedance between the charger and the photoconductive drum based on the present environment information and impedance characteristics data, wherein the impedance characteristics data is obtained in advance by experiments and represents a relationship between environment information about environmental conditions around the photoconductive drum and impedance between the charger and the photoconductive drum; and generating the voltage which is an alternating current voltage superimposed on a direct current voltage, based on the impedance calculated.

14. The method according to claim 13, wherein the environment information includes an ambient temperature of the photoconductive drum.

15. The method according to claim 13, further comprising:

controlling such that the voltage generated is constant.

* * * * *